US010974363B2

(12) United States Patent
Schauer

(10) Patent No.: US 10,974,363 B2
(45) Date of Patent: Apr. 13, 2021

(54) MONITORING OF PNEUMATIC CONNECTION TO CARRIER HEAD

(71) Applicant: Applied Materials, Inc., Santa Clara, CA (US)

(72) Inventor: Ronald Vern Schauer, Gilroy, CA (US)

(73) Assignee: Applied Materials, Inc., Santa Clara, CA (US)

( * ) Notice: Subject to any disclaimer, the term of this patent is extended or adjusted under 35 U.S.C. 154(b) by 373 days.

(21) Appl. No.: 15/995,006

(22) Filed: May 31, 2018

(65) Prior Publication Data

US 2018/0290260 A1 Oct. 11, 2018

Related U.S. Application Data

(60) Division of application No. 14/922,651, filed on Oct. 26, 2015, now Pat. No. 9,987,718, which is a continuation of application No. 13/788,671, filed on Mar. 7, 2013, now Pat. No. 9,168,629.

(60) Provisional application No. 61/608,266, filed on Mar. 8, 2012.

(51) Int. Cl.

| | |
|---|---|
| ***B24B 37/005*** | (2012.01) |
| ***B24B 37/30*** | (2012.01) |
| ***B24B 49/12*** | (2006.01) |

(52) U.S. Cl.

CPC ..... *B24B 37/005* (2013.01); *B24B 37/30* (2013.01); *B24B 49/12* (2013.01)

(58) Field of Classification Search

CPC ..... B24B 37/005; B24B 37/30; B24B 49/12; B24B 49/16; B24B 51/00

USPC ..... 451/5, 6, 8, 9, 10, 11, 24, 41, 287, 288

See application file for complete search history.

(56) References Cited

U.S. PATENT DOCUMENTS

| | | | | |
|---|---|---|---|---|
| 3,936,192 | A | 2/1976 | Skala | |
| 5,738,574 | A | 4/1998 | Tolles et al. | |
| 6,183,354 | B1 | 2/2001 | Zuniga et al. | |
| 6,341,995 | B1 | 1/2002 | Lai et al. | |
| 6,503,134 | B2 | 1/2003 | Shendon | |
| 6,508,695 | B2 * | 1/2003 | Tanikawa | B24B 37/04 210/194 |
| 6,645,050 | B1 * | 11/2003 | Butterfield | B24B 37/32 257/E21.23 |

(Continued)

FOREIGN PATENT DOCUMENTS

| | | |
|---|---|---|
| JP | 10-115590 | 5/2010 |
| KR | 10-2003-0027389 | 4/2003 |

(Continued)

OTHER PUBLICATIONS

International Search Report and Written Opinion in International Application No. PCT/US2013/028724, dated Jun. 3, 2013, 11 pages.

(Continued)

*Primary Examiner* — Orlano E Aviles
*Assistant Examiner* — Robert F Neibaur
(74) *Attorney, Agent, or Firm* — Fish & Richardson P.C.

(57) ABSTRACT

A chemical mechanical polishing system includes a carrier head having a flexible membrane and a chamber to apply pressure to the flexible membrane, a pressure control unit, a pressure supply line connecting the pressure control unit to the chamber, and a sensor located along the pressure supply line to detect a contaminant in the pressure supply line.

12 Claims, 5 Drawing Sheets

(56) References Cited

U.S. PATENT DOCUMENTS

| | | | | |
|---|---|---|---|---|
| 6,663,466 | B2 | 12/2003 | Chen et al. | |
| 6,857,931 | B2 | 2/2005 | Chen et al. | |
| 7,699,688 | B2 | 4/2010 | Zuniga et al. | |
| 8,882,563 | B2 | 11/2014 | Boo | |
| 9,168,629 | B2 | 10/2015 | Schauer | |
| 9,199,354 | B2 | 12/2015 | Duescher | |
| 2001/0041526 | A1 | 11/2001 | Perlov | |
| 2005/0260925 | A1 | 11/2005 | Togawa | |
| 2006/0052037 | A1 | 3/2006 | Izumi et al. | |
| 2007/0111637 | A1 | 5/2007 | Togawa | |
| 2009/0314369 | A1* | 12/2009 | Pozniak | F17D 5/02 137/861 |
| 2010/0026988 | A1 | 2/2010 | Cros et al. | |
| 2010/0035526 | A1 | 2/2010 | Tolles | |
| 2011/0051140 | A1 | 3/2011 | Stevens et al. | |
| 2014/0138355 | A1 | 5/2014 | Yavelberg | |

FOREIGN PATENT DOCUMENTS

| | | |
|---|---|---|
| TW | 436380 | 5/2001 |
| TW | 478998 | 3/2002 |
| TW | I292729 | 1/2008 |
| TW | 201104373 | 2/2011 |

OTHER PUBLICATIONS

Taiwanese Examination Report in Taiwanese Application No. 102107883, dated Dec. 25, 2017, 10 pages (English Search Report).

* cited by examiner

MONITORING OF PNEUMATIC CONNECTION TO CARRIER HEAD

CROSS-REFERENCE TO RELATED APPLICATIONS

This application is a divisional of U.S. application Ser. No. 14/922,651, filed Oct. 26, 2015, which is a continuation of U.S. application Ser. No. 13/788,671, filed Mar. 7, 2013, which claims priority to U.S. Provisional Application Ser. No. 61/608,266, filed Mar. 8, 2012, the entire disclosures of which are incorporated by reference.

TECHNICAL FIELD

This disclosure relates to a carrier head for chemical mechanical polishing.

BACKGROUND

Integrated circuits are typically formed on substrates, particularly silicon wafers, by the sequential deposition of conductive, semiconductive or insulative layers. After each layer is deposited, the layer is etched to create circuitry features. As a series of layers are sequentially deposited and etched, the outer or uppermost surface of the substrate, i.e., the exposed surface of the substrate, becomes increasingly non-planar.

Chemical mechanical polishing (CMP) is one accepted method of planarizing a substrate surface. This planarization method typically requires that the substrate be mounted to a carrier or polishing head. The exposed surface of the substrate is then placed against a rotating polishing pad.

Some carrier heads include a flexible membrane with a mounting surface for the substrate. A chamber on the other side of the membrane can be pressurized to press the substrate against the polishing pad. A pneumatic control unit system outside the carrier head can control the pressure applied to the chamber, e.g., through pressure supply lines, in order to control the pressure applied to the substrate.

SUMMARY

One problem that has been encountered in CMP is that the flexible membrane can break during polishing. Without being limited to any particular theory, possible causes for breaking of the membrane include frictional forces from the substrate on the membrane, as well as breakage of the substrate that creates shards that cut the membrane.

Detection of membrane breakage can sometimes be accomplished by sensing changes in the pressure or vacuum applied to the pressure supply line leading to the chamber in the carrier head if the rate of leakage is sufficient that the pressure or vacuum supply device can not self-adjust to maintain the desired pressure or vacuum level. For example, if the leak is small, the pressure or vacuum supply device may easily be able to self-compensate for the leak rate and therefore the leak may not be detectable by changes of pressure or vacuum levels. If vacuum (including partial vacuum) is being applied to the chamber when the membrane breaks, then slurry or other fluids can be suctioned into the pressure supply line, and this slurry can reach and contaminate the pneumatic control system before the pressure sensor detects that the membrane has broken, even assuming that the breakage of the membrane can be sensed in this manner. At a minimum, the pressure supply line and pneumatic control system will need to be cleaned prior to resumption of substrate polishing. Worse, when the pneumatic control system is contaminated (with slurry in particular), it can become non-salvageable, and replacement of the components can be quite costly in terms of time and money.

However, an optical sensor can be located in the carrier head or in the pressure supply line ahead of the pneumatic control system to detect the passage of contaminants, e.g., slurry, into the pressure supply line. A signal from such a sensor can be used to stop application of vacuum to the pressure supply line, thus reducing the risk of contamination of the remainder of the pneumatic control system due to membrane breakage.

In one aspect, a chemical mechanical polishing system includes a carrier head having a flexible membrane and a chamber to apply pressure to the flexible membrane, a pressure control unit, a pressure supply line connecting the pressure control unit to the chamber, and a sensor located along the pressure supply line to detect a contaminant in the pressure supply line.

Implementations may include one or more of the following features. The sensor may be an optical sensor. The pressure supply line may include a transparent portion, and wherein the optical sensor may include a detector and a light source configured to direct light through the transparent portion to the detector. A drive shaft may be connected to the carrier head. The pressure supply line may include a passage in the drive shaft and the transparent portion may be a portion of the drive shaft. The pressure supply line may include tubing fluidically coupling the drive shaft to the pressure control unit, and the transparent portion may be a portion of the tubing. The carrier head may have a plurality of chambers including the chamber, and the polishing system may include a plurality of pressure supply lines including the supply line, the plurality of chambers connected to the plurality of pressure supply lines. There may be a sensor for each supply line of the plurality of pressure supply lines. The plurality of pressure supply lines may pass through a rotating transparent body, and the sensor may be configured to monitor the pressure supply lines in sequence. The sensor may include a first optical sensor and a second optical sensor. The first optical sensor may be configured to detect water. The second optical sensor may be configured to detect a component of a polishing liquid other than water. The system may include a polishing pad and a dispenser configured to supply the polishing liquid to the polishing pad, and the second optical sensor may include a wavelength bandpass filter configure to pass a wavelength of light at an absorption peak of the component of the polishing liquid other than water. The first optical sensor and the second optical sensor may be positioned in sequence along the pressure supply line. The first optical sensor may generate a first light beam and the second optical sensor may generate a second light beam that crosses the first light beam at an angle. The first optical sensor may generate a first light beam and the second optical sensor may generate a second light beam that is combined with the first light beam. A controller may be configured to cause the pressure control unit to stop applying vacuum to the pressure supply line when the sensor detects the contaminant. The controller may be configured to cause the pressure control unit to apply a positive pressure to the pressure supply line when the sensor detects the contaminant. The controller may be configured to cause the pressure control unit to shut a valve to the pressure supply line when the sensor detects the contaminant. The controller may be a portion of the pressure control unit. The controller may be a portion of a polishing control system that supplies pressure instructions to the pressure control unit. The controller may be a portion of a bridge between the pressure control unit and a polishing control system that supplies pressure instructions to the pressure control unit.

The details of one or implementations are set forth in the accompanying drawings and the description below. Other features, objects, and advantages will be apparent from the description and drawings, and from the claims.

DESCRIPTION OF DRAWINGS

Like reference symbols in the various drawings indicate like elements.

DETAILED DESCRIPTION

As described herein, sensor devices are used to detect the presence of fluid, either as a solid column or as droplets, in the vacuum supply line to the carrier head. The optical sensor devices can be externally attached to carrier head supply tubing in close proximity to the carrier head or its rotary fluid coupling, be added into the carrier head itself, or be inserted between the carrier head and rotary fluid coupling using optical coupling. The sensor devices may be mounted in closer proximity to the pressure or vacuum supply device so as to simplify connections to the system controller or to enable mounting in extremely dense hardware environments.

It is important to be able to sense not only the bulk presence of fluid within the supply line, e.g., a solid column of fluid, but also the passage of a leading or trailing edge meniscus of a fluid, as well as small droplets of fluid which may indicate minor leaks or leaks in positions on the carrier head that are not continuously exposed to fluid or slurry. Minor leaks often precede a larger leak or column of fluid, and may easily contaminate pressure control devices up stream.

One potential technique is to insert electrodes into the tubing interior or into parts of fittings inserted into the tubing path so that the presence of slurry in the pneumatic system would effect a change in electrical conductance. A potential flaw in this method is that, the fluid being aspirated into the vacuum source may be water or de-ionized water or non-ionic slurry, neither of which may conduct electrical current in sufficient amounts to be reliably detected. This method also requires the sensing electrodes to be thoroughly clean and dry before production can be resumed, and there is an added probability of electrode corrosion and resulting metallic ion contamination. Also, this method may not detect small droplets of fluid unless the electrodes are spaced very close together, in which case the sensor become prone to false triggers due to surface electrical leakage between the electrodes.

Another potential technique is to direct acoustic energies, e.g., sound waves, at or through tubing or other structures located within the tubing path. A potential problem with this is that it can lack of sufficient sensitivity to detect small droplets, and has a large variability of response to differing densities of fluids, high cost and complexity of the required hardware, calibration issues, drift due to the temperature of the gasses, fluids and hardware, and susceptibility to external noise and vibration.

Although the sensor systems described above could potentially be used, as described below, an optical sensor can be used to detect the presence of fluid in the vacuum supply line to the carrier head. An optical sensor can avoid some of the problems described above.

Figure 1:
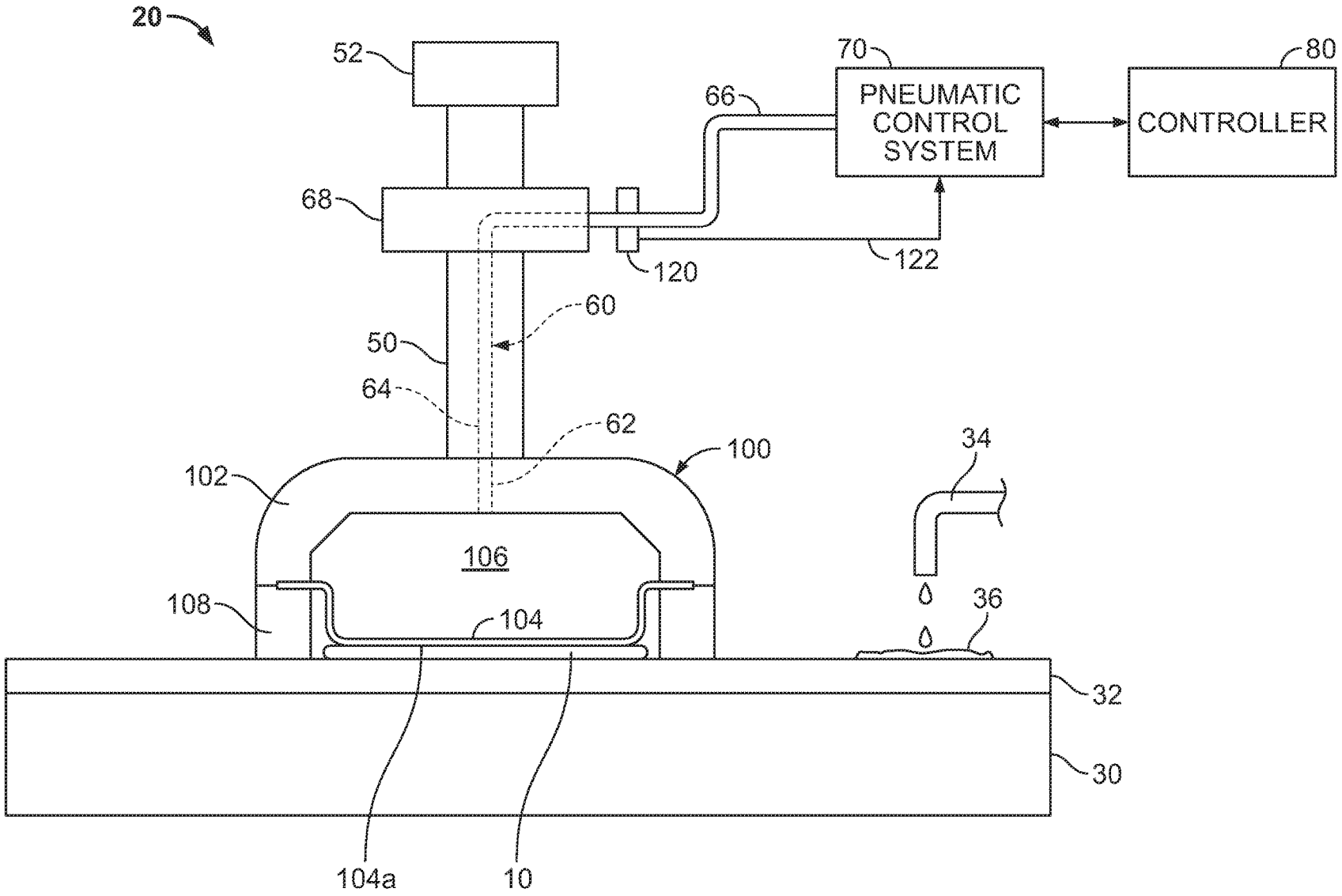
FIG. 1 is a schematic diagram of a chemical mechanical polishing system.

A carrier head 100 of a chemical mechanical polishing (CMP) apparatus 20 is illustrated schematically in FIG. 1. A description of a CMP apparatus may be found in U.S. Pat. No. 5,738,574, the entire disclosure of which is incorporated herein by reference. The CMP apparatus 20 can include a rotatable platen 30 that supports a polishing pad 32, and a dispenser 34 that supplies slurry 36 to the surface of the polishing pad 32.

The carrier head 100 includes a base 102 and a flexible membrane 104 connected to the base 102 which defines at least one pressurizable chamber 106 located between the base 102 and the flexible membrane 104. A lower surface 104*a* of the flexible membrane 104 provides a substrate mounting surface to receive the substrate 10. When the chamber 106 is pressurized, the flexible membrane 104 provides a controllable load on the substrate 10. Although only one chamber 106 is illustrated, the flexible membrane 104 can include multiple flaps that define multiple independently pressurizable chambers.

The carrier head can also include a retaining ring 108 to hold the substrate 10 below the flexible membrane 104. The base 102 can be directly secured to a drive shaft 50. Alternatively, the base 102 can be connected to a housing which is secured to the drive shaft, and a chamber between the base 102 and the housing can control the vertical position of the base. Other features of the carrier head may be found in U.S. Pat. No. 7,699,688, the entire disclosure of which is incorporated herein by reference. The drive shaft 50 can be turned by a motor 52 to rotate the carrier head 100.

The chamber 106 is fluidically connected by a pressure supply line 60 to a pneumatic control system 70, e.g., a system of pressure sensors and valves that can regulate pressure in the pressure supply passage 60 and thus the pressure in the chamber 106. The pressure supply line 60 can include a passage 62 that extends through the base 102, a passage 64 in the drive shaft 50, and tubing 66, e.g., a pipe or hose. A first end of the passage 62 in the base 102 opens to the chamber 106. A second end of the passage 62 in the base 102 can be connected to the first end of the passage 64 in the drive shaft 50. A second end of the passage 64 in the drive shaft 50 can be connected to a first end of the tubing 66 by a rotary coupler 68. A second end of the tubing 66 is connected to the pneumatic control system 70. However, many other arrangements are possible for the pressure supply line 60. For example, if the shaft 50 does not rotate, then the rotary coupler 68 could be omitted or the tubing 66 could be connected directly to the carrier head 100 (bypassing the drive shaft 50).

The system can also optionally include a controller 80, e.g., a microprocessor, and the controller 80 could be configured to control the operation of the polishing system, e.g., the rotation rate of the platen 30, the rotation rate of the carrier head 10, etc., by connection to the respective motors or actuators. The controller 80 can be configured to store or determine a desired pressure for the chamber 106 in the carrier head 100, and the controller 80 and pneumatic control system 70 can communicate, e.g., the controller 80 can be configured to send commands to the pneumatic control system 70 in response to which the pneumatic control system applies the desired pressure to the pressure supply line 60. The controller 80 can include a computer program product implemented in non-transient computer readable media to perform these and other operations. For example, if the carrier head includes multiple chambers, the controller 80 can also be configured to set the pressures in the multiple chambers to provide improved polishing uniformity.

A sensor 120 is located along the pressure supply line 60, and the sensor is configured to detect the passage of liquids or solids through the pressure supply line 60. The sensor 120 is connected to the pneumatic control system 70 by a control line 122, and detection of liquids or solids through the pressure supply line 60 can trigger a control signal on the control line 122. Assuming that air or another gas is used for the pneumatic control of the chamber 106, then presumably the presence of liquids or solids in the pressure supply line 60 indicates that the membrane 104 has broken and that slurry is being suctioned into the pressure supply line 60 and might reach the pneumatic control system 70. Thus, in response to the control signal on the control line 122, the pneumatic control system 70 can immediately shut off vacuum to the pressure supply line 60, thus reducing the risk of slurry or other contaminates from reaching the pneumatic control system 70.

Figure 2:
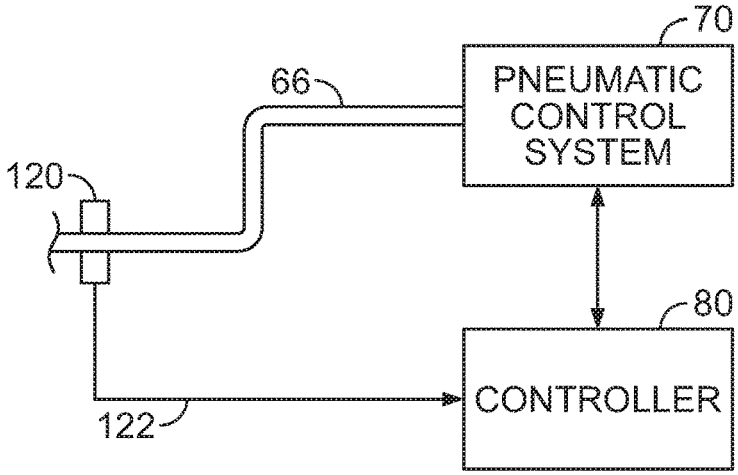
FIG. 2 is a schematic diagram of an arrangement of a sensor, pneumatic control system and controller.

Alternatively, as shown in FIG. 2, the sensor 120 could be connected to the controller 80, and the controller 80 could be configured to cause the pneumatic control system 70 to shut off vacuum to the pressure supply line 60 when a contaminate is detected.

Figure 3:
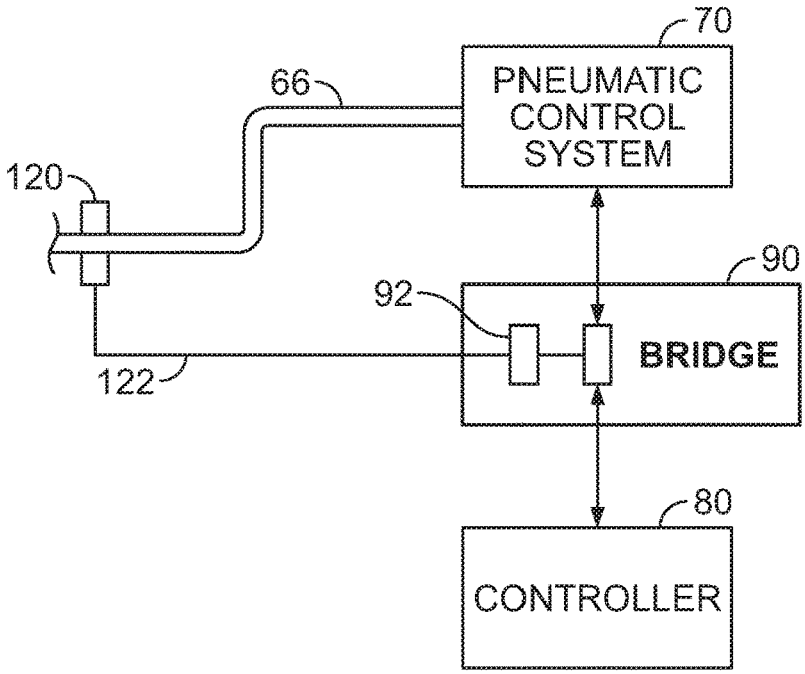
FIG. 3 is a schematic diagram of another arrangement of a sensor, pneumatic control system and controller.

Alternatively, as shown in FIG. 3, the system 20 could include a controller 80 configured to set one or more pressures applied by the carrier head, and a bridge 90 connecting the controller 80 to the pneumatic control system 70. The bridge 90 can include an error processor 92. In normal operation, the bridge 90 merely passes signals from the controller 80 to the pneumatic control system 70. However, if the error processor 92 determines that the signal from the sensor 120 indicates the presence of a liquid or solid in pressure supply line 60, the error processor 92 can substitute the command from the controller 80 with a command to shut off vacuum.

In any of these implementations, the command to shut off vacuum can include either a command to apply a positive pressure to the pressure supply line 60 or a command to vent the pressure supply line 60, e.g., by connecting the pressure supply line 60 to atmosphere. In addition, the controller 80 can be configured to cause the polishing system to halt any polishing operation on detection of a contaminant.

Although FIG. 1 illustrates the sensor 120 as located on the tubing 122 adjacent the rotary coupler 68, the sensor could be located at other positions along the pressure supply line 60. However, the sensor 120 should be located in a position such that it would take liquid at least five to seven milliseconds to pass from the sensor 120 to the pneumatic control system 70. For example, the sensor 120 could be located along the passage 64 in the drive shaft, or potentially within the carrier head 100 itself. If the sensor is attached to a rotating part and is itself rotating, the sensor can communicate by a wired connection through the rotary coupler 68 or a by wireless connection.

Figure 4:
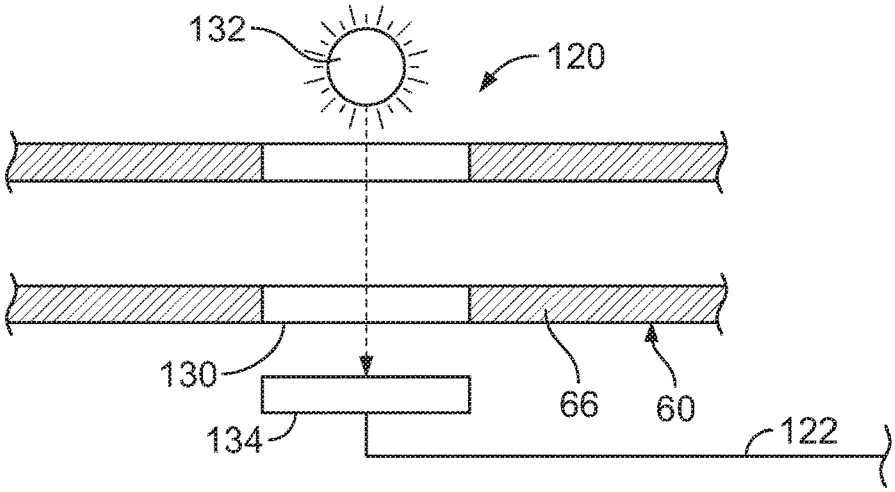
FIG. 4 is a schematic diagram of an optical sensor.

The sensor 120 can be an optical sensor. Referring to FIG. 4, in some implementations, a portion of the pressure supply line 60, e.g., a portion 130 of the tubing 66, can be made of a transparent material, e.g., quartz or glass. The sensor 120 can include a light source 124, e.g., a light emitting diode, and a detector 126, e.g., a photodiode. The light source 124 is positioned to direct light through the transparent portion 130 of the pressure supply line 60 to the detector 126. If liquid and/or solids, e.g., the slurry, passes through the pressure supply line 60 between the light source 124 and the detector 126, there will be a change in the light, e.g., a change to polarization or intensity, which can be detected by the detector 126. The light source 124, detector 126, and transparent portion 130 can be enclosed in an opaque housing to improve the signal-to-noise ratio for the detector. For example, assuming that polishing liquid is a slurry that includes particulates, then when the particulates pass into between the light source 124 and the detector 126, the particulates will absorb or scatter light, causing a reduction in the detected light intensity by the detector 126. Of course, the optical sensor can operate in the ultraviolet or infrared range, in which the portion 130 of the tubing 66 will be transparent to the optical sensor 120, but might not be transparent to visible light.

One potential problem is that when the membrane breaks, the concentration of particulates in the liquid flowing into the pressure supply line may not be sufficiently high to significantly affect the light intensity on the detector. However, various modifications can be made to the sensor so that it is capable of detecting liquids that with a low concentration (or no) particulates.

Figure 5:
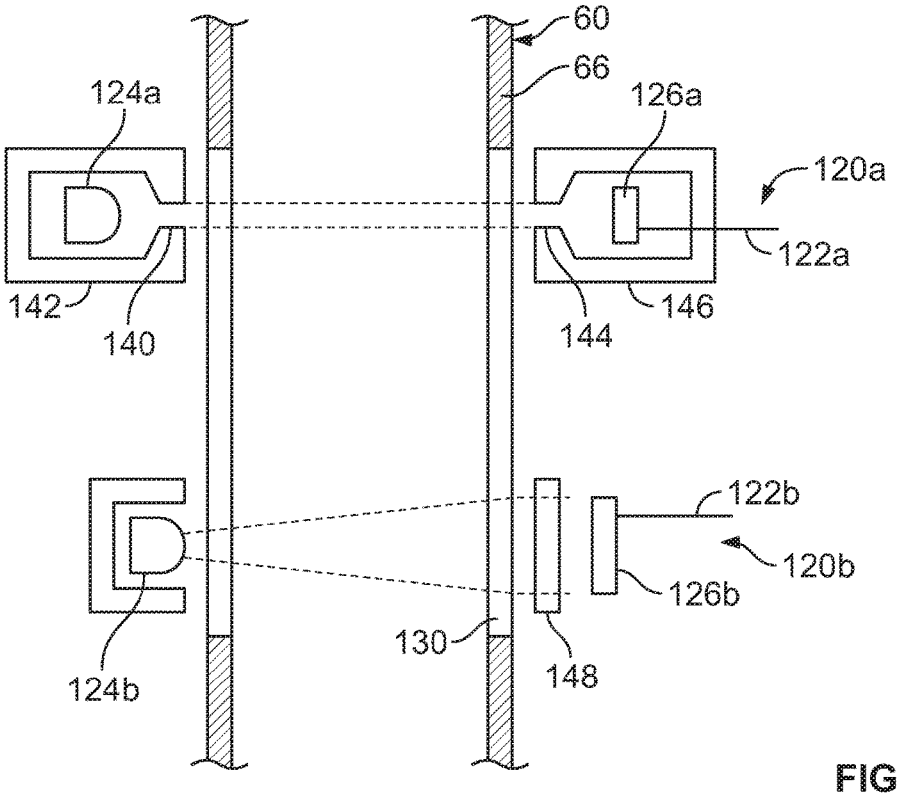
FIG. 5 is a schematic diagram of a sensor that includes two optical sensors.

Referring to FIG. 5, in some implementations the sensor 120 can include multiple optical sensors 120*a*, 120*b* on the same pressure supply line 60. Although FIG. 5 illustrates the first and second optical sensors 120*a* and 120*b* as directing light through one transparent portion 130 of the pressure supply line 60, there could be different transparent portions, e.g., separated by an opaque region, for the first and second optical sensors 120*a* and 120*b*.

The sensors can be configured for detection of different types of contaminants in the pressure supply line 60. The first and second optical sensors 120*a* and 120*b* can use different wavelengths of light. For example, the first optical sensor 120*a* could be configured to detect the presence of water, and the second optical sensor 120*b* could be configured to detect the presence of polishing liquid, e.g., water mixed with a pH adjustor such as potassium hydroxide (KOH) or hydrofluoric acid (HF).

The first optical sensor 120*a* includes a light source 124*a*, an optical aperture 140, e.g., provided by a housing 142, between the light source 124*a* and the transparent portion 130, a detector 126*a*, and an optical aperture 144, e.g., provided by a housing 146, positioned between the detector 126*a* and the transparent portion 130. The optical apertures 140 and 144 are positioned such that, during normal operation, a light beam passes from the light source 124*a* to the detector 126*a*. However, the optical apertures 140 and 144 are sized such that, should water pass through the transparent portion 130, the meniscus of the water causes refraction of the light beam away from the aperture 144, resulting in a decrease in the light intensity detected by the detector 126*a*.

The light source 125*a* of the first optical sensor 120*a* can be a light emitting diode, and can have a wavelength centered around 680 nm.

The second optical sensor 120*b* includes a light source 124*b* and a detector 126*b*. The second optical sensor 120*b* is configured such that, in normal operation, only light in a narrow wavelength band reaches the detector 126*b*. The narrow wavelength band can correspond to an absorption peak of a component in the polishing liquid, e.g., a component other than water, e.g., an absorption peak of a pH adjustor, such as potassium hydroxide (KOH) or hydrofluoric acid (HF), or a viscosity adjustor. For example, if the polishing liquid includes potassium hydroxide, then the wavelength band can be centered at about 840 nm, and can be about 20 nm wide. Consequently, when fluid including the component in the polishing liquid passes through the transparent portion 130, the absorption peak causes absorption of the light beam, resulting in a decrease in the light intensity detected by the detector 126*b*. The absorption peaks for other components of the polishing liquid can be determined empirically or from literature.

To provide the narrow wavelength band, the light source 124*b* can be a relatively broad band light source and the second optical sensor 120*b* can include a filter 148 positioned in the path of the light between the light source 124*b* and the detector 126*b*. For example, the filter 148 can be between the detector 126*b* and the transparent portion 130 as shown in FIG. 5, although alternatively the filter 148 could be between the light source 124*b* and the transparent portion 130. Alternatively, the light source 124*b* can be a narrow band light source, e.g., a laser.

The bridge 90, controller 80 and/or pneumatic control system 70 can be configured to treat the signals from the first and second optical sensors 120*a* and 120*b* differently. For example, in response to a signal on control line 122*a* that the first optical sensor 120*a* has detected water, then the bridge 90, controller 80 and/or pneumatic control system 70 can be configured to apply a positive pressure to the pressure supply line 60 in order to drive the liquid out of the pressure supply line 60. In contrast, in response to a signal on control line 122*b* that the second optical sensor 120*a* has detected slurry, then the bridge 90, controller 80 and/or pneumatic control system 70 can be configured to shut a valve between the pressure supply line 60 and the pneumatic control system 70.

Figure 6:
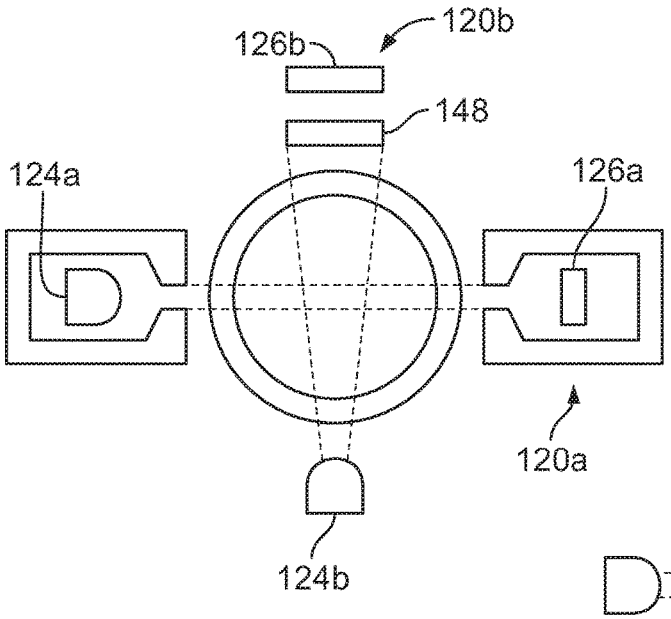
FIG. 6 is a schematic diagram of another implementation of a sensor that includes two optical sensors.
Figure 7:
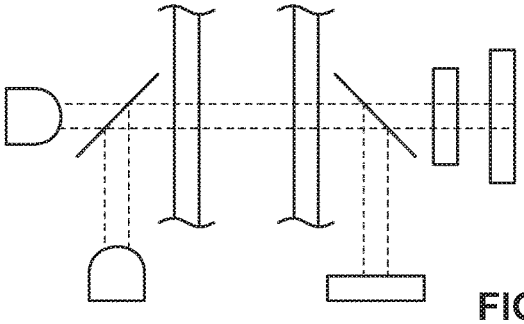
FIG. 7 is a schematic diagram of another implementation of a sensor that includes two optical sensors.

In the implementation illustrated in FIG. 5, the first optical sensor 120*a* and the second optical sensor 120*b* are located in sequence along the pressure supply line 60. However, as shown by FIGS. 6 and 7, the first optical sensor 120*a* and the second optical sensor 120*b* can be located at the same position along the pressure supply line 60. In FIG. 6, the first optical sensor 120*a* and the second optical sensor 120*b* direct light through the same transparent portion 130 of the pressure supply line, but are oriented such that the light from the light sources 124*a* and 124*b* cross at an angle, e.g., are substantially perpendicular. In FIG. 7, light from light sources 124*a* and 124*b* is combined into a combined light beam, e.g., by a partially reflective mirror 150, the combined light beam is directed through the pressure supply line 60, the combined light beam is then split back into component light beams, e.g., by a dichroic mirror, and directed to the first and second detectors 126*a* and 126*b*. Of course, the system could also be configured with just the first optical sensor 120*a* or just the second optical sensor 120*b*, rather than both.

Figure 8:
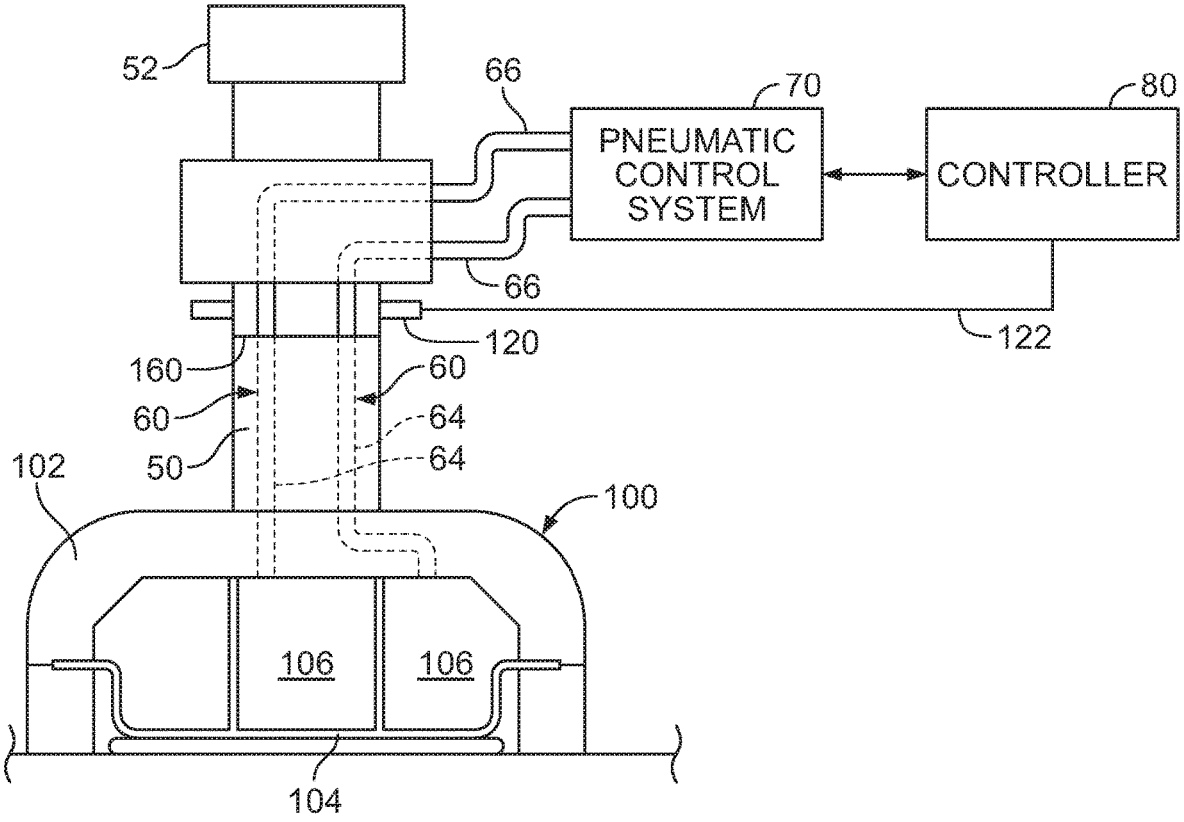
FIGS. 8 and 9 are schematic diagrams, cross-sectional side and top views, respectively of a sensor for multiple pressure control lines.
Figure 9:
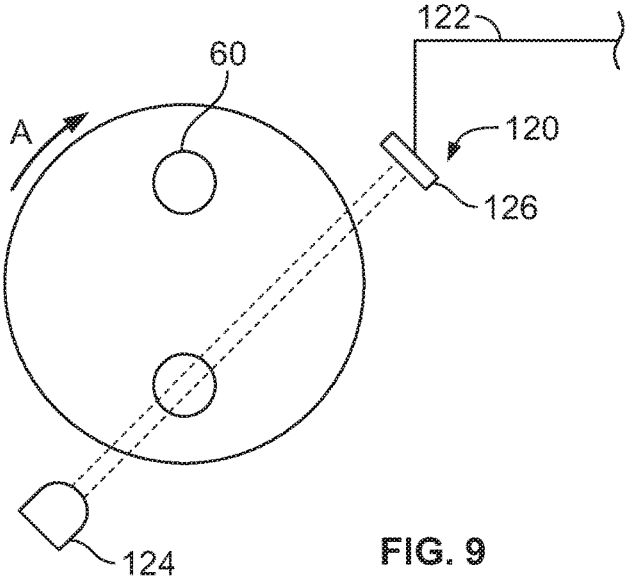

As shown by FIGS. 8 and 9, if the carrier head includes multiple chambers 106, then there can be multiple pressure supply lines 60, e.g., one for each chamber, with multiple passages 62 and 64 and tubing 66 (although only two chambers are shown in FIG. 8, there could be three or more chambers, e.g., six chambers).

In some implementations the pressure supply lines 60 can be pass through a rotating transparent part 160. The rotating transparent part 160 can be positioned just below the rotary coupler 68, e.g., it can connect the drive shaft 50 to the rotary coupler 68. The sensor 120 can be in a fixed position, i.e., not rotating, with the light source 124 and detector 126 positioned such that the light passes through one pressure supply lines at a time. Thus, as the transparent part 160 rotates (as shown by arrow A), the light will pass through each pressure supply line 60 in sequence. The portions of the signal from the sensor 120 can be associated with the respective pressure supply lines 60, e.g., by the controller 80, and the pressure supply lines 60 can be independently controlled based on the portion of the signal associated with the respective pressure supply line 60.

Alternatively, there can be a separate sensor 120 for each pressure supply line 60, and the control signal from each sensor 120 can be supplied to the pneumatic control system, controller or bridge on separate lines 122.

A potential advantage of the some implementations is that the sensor can be retrofit into existing hardware.

Apertures, optical slits, refractive edges, polarizing devices, reflectors, crossed light beams, beam splitters, optical spatial filters and other devices can be used to enhance the sensitivity of the sensor. This can enable sensing of even very small droplets of liquid within the tubing path in addition to sensing the presences of bulk fluid.

The adaptive hardware to interface the sensor devices to the system controller may be mounted in close proximity to the sensors (i.e., on a carrier head support structure or at the carrier head itself), on the structure of the polishing tool with connective wiring routed through the motion linkage from the carrier head support structure, or remotely at the system controller.

In some implementations, the interface hardware can be configured to operate in a stand-alone manner so as to independently influence the pressure or vacuum supply device(s) in a manner to minimize intrusion of fluid or slurry into the plumbing path. This may include intercepting in the control signals that affect the operation of the pressure or vacuum supply devices or by inserting secondary control devices such as pneumatic valves into the fluid paths between the pressure or vacuum supply devices and the carrier head.

In some implementations, the interface hardware can be operated with the interface outputs connected to another sub-system controller which can effect more immediate protective actions than the system controller is capable of performing. Devices of this nature may often be used to buffer, scale or otherwise interpret pressure or vacuum level commands to the pressure or vacuum supply devices from the system controller, so therefore the addition of a fluid detection function may be simple to effect.

In some implementations, the interface hardware can be operated by connecting the interface output signals directly to the system controller and requiring that the system controller commands outcomes based upon the wishes of a system operator, programmer or technician The optical sensors can include narrow rectangular apertures, optical slits, and refractive edges to enhance the optical contrast of passing droplets, columns of fluid or fluid meniscus transitions. The optical edges for example work by partially blocking some tightly controlled portion of the optical beam so that any refractive edge of any passing obstruction or droplet will greatly affect the amount of light that passes. This also has a potential advantage over narrow apertures in that it can be more sensitive to bulk fluid columns in some applications because it maintains a greater "view" through the tubing than a narrow slit or aperture. With this approach fine particulates can have a greater bulk effect on the transmitted light than in a narrow view slice. The optical edges approach also tends to have better average sensitivity to the passage of tiny droplets because an aperture may not be favorably aligned with them, and a slit would have to cover substantially the entire internal width of the tubing to see absolutely anything that passed by, which may be impractical to manufacture.

Figure 10:
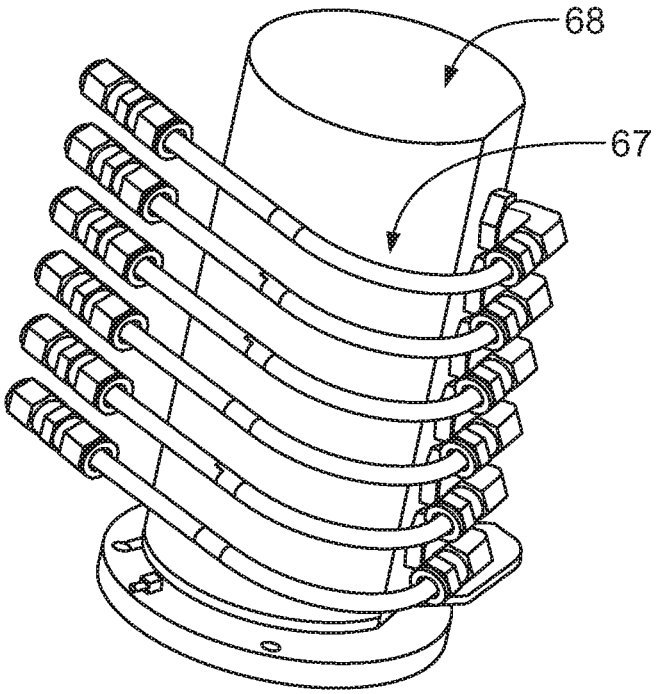
FIG. 10 is an illustration of tubing around a rotary union.
Figure 11:
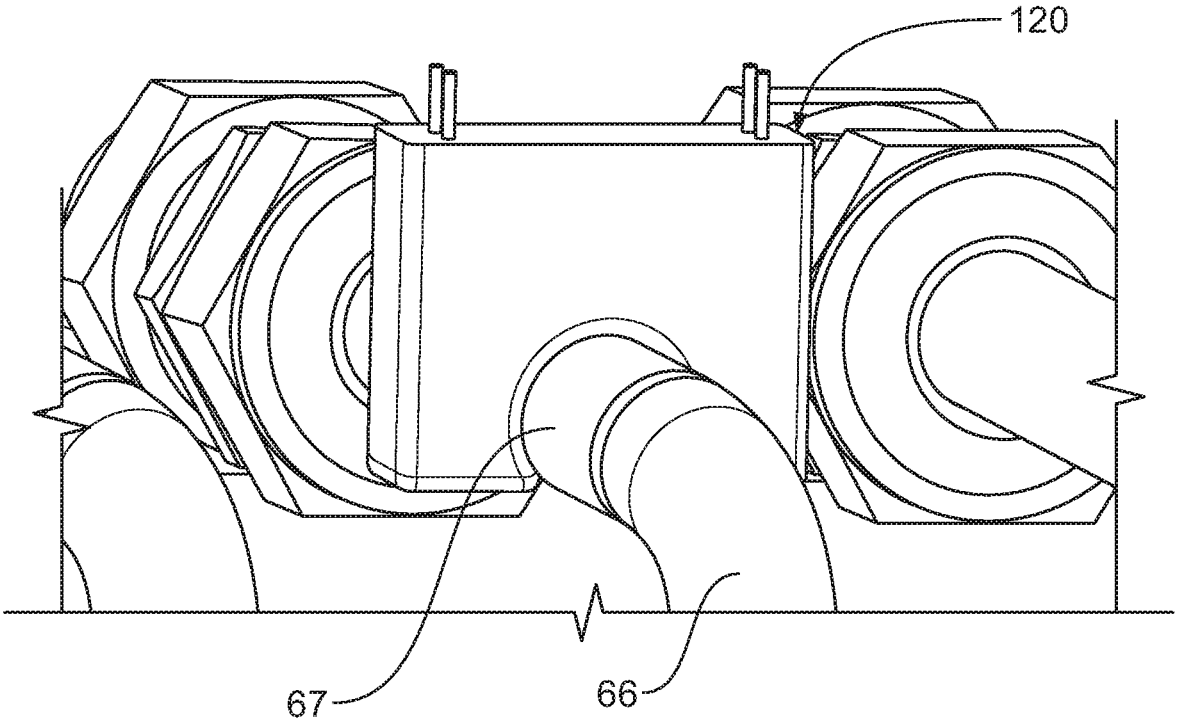
FIG. 11 is an illustration of an optical sensor clipped on to tubing.

Referring to FIGS. 10 and 11, in some implementations, the optical sensor 120 will clip on to the exterior of tubing 66 near the rotary union 68 that feeds the carrier head 100. This has the potential advantage of being non-intrusive so as to eliminate the possibility of contamination of the head chambers and pneumatic pressure control hardware (which can have very small internal orifices and therefore can be sensitive to dirt). It also has a potential advantage as shown in that the length of tubing 67 being monitored may be different than the remainder of the feed tubing 66 (e.g., color, material or wall thickness) and therefore can be standardized, which simplifies calibration. Moreover it also can be considered to be an inexpensive sacrificial length of tubing which, if contaminated, may simply be discarded rather than cleaned.

If the sensor and control circuitry (or tool controller) responds rapidly enough, the contamination may be limited solely to these short lengths of sacrificial tubing, thus greatly lowering the time and cost to bring the tool back into production status. Finally, it allows better mechanical alignment and control of the monitored tubes during assembly and usage (such as eliminating the need for external clamps to stabilize the tube positions) and shields the sensors from ambient light in a predictable manner.

Alternatively, specialized chambers can be created to mount in line with the feed path tubing or carrier head so that the optical path characteristics may be carefully controlled. An example is to have short lengths of rigid plastic, glass or quartz tubing inserted into the pneumatic paths. Because these would be rigid materials, clip on sensors could probably not be utilized. In this case the tubing would be mounted to an alignment base and a sensor or array of sensors would also be mounted on the base and be mechanically aligned to the tubing. Even though this approach is considerably more expensive to manufacture, it would have the advantage of being simple to clean and relatively unaffected by the presence of corrosive slurry. Moreover if mechanically constrained, the operation of the sensors may become more predictable and could be further enhanced with devices such as polarizing filters, precision slits or edges and even such spatial enhancement devices as Fourier or Moire pattern filters or gratings. All of these could require levels of alignment precision that may not be practical in clip-on sensor embodiments such as would be used on flexible or semi-rigid tubing. These short lengths of rigid tubing would be made available as standardized replacement parts, as would be the flexible sacrificial tubing lengths mentioned earlier.

When applied to traditional pressure controls, e.g., upper pneumatic assembly UPA) devices, mounted in close proximity to the carrier heads on a typical CMP machine polisher's cross tips, the benefit to the present system is even more considerable than when applied to remotely mounted pressure controls. The locally mounted controls often incorporate laminated metal or plastic pneumatic manifolds which, if contaminated with slurry, can not typically be cleaned and salvaged. The repair costs incurred with a membrane breakage and slurry aspiration event therefore may include replacement of the manifolds and quite often, the control valves as well. The need to limit contamination to the feed tubing only and to prevent manifold and valve contamination from occurring is therefore. In this instance the tubing path between the pressure controls and the carrier heads or their coupling devices may be very short. To that end, the present system can be capable of retro-fit to traditional UPA devices in minimal tubing length and to have a very rapid response time (on the order of 1 millisecond or preferably less).

A number of embodiments have been described. Nevertheless, it will be understood that various modifications may be made. For example, although the carrier head has been described as part of a chemical mechanical polishing apparatus, it may be adaptable to other types of processing systems, e.g., wafer transfer robots or electroplating systems. In the CMP system, the platen need not be rotatable or could be omitted entirely, and the pad could be circular or linear and could be suspended between rollers rather than attached to a platen.

Accordingly, other embodiments are within the scope of the following claims.

What is claimed is:

1. An assembly for a chemical mechanical polishing system, comprising:

a sensor configured to be located along a pressure supply line between a carrier head of the chemical mechanical polishing system and a pressure control unit;

a processor to receive a signal from the sensor and configured to determine whether a contaminant is in the pressure supply line based on the signal, wherein the processor is configured to determine whether a liquid contaminant is in the pressure supply line; and a controller configured to control pressure applied to the pressure supply line, wherein the controller is configured to switch the pressure supply line from vacuum to a positive pressure when the processor determines that the liquid contaminant is in the pressure supply line.

2. The assembly of claim 1, wherein the controller is configured to cause a valve between the pressure supply line and the pressure control unit to shut when the processor determines that the liquid contaminant is in the pressure supply line.

3. The assembly of claim 1, wherein the controller is configured to cause the pressure supply line to be vented when the processor determines that the contaminant is in the pressure supply line.

4. The assembly of claim 1, wherein the controller is configured to halt a polishing operation on a polishing system when the processor determines that the contaminant is in the pressure supply line.

5. The assembly of claim 1, wherein the processor is configured to determine whether a solid contaminant is in the pressure supply line.

6. The assembly of claim 1, wherein the sensor comprises an optical sensor.

7. The assembly of claim 1, wherein the sensor comprises a first optical sensor and a second optical sensor.

8. The assembly of claim 7, wherein the first optical sensor is configured to detect water.

9. The assembly of claim 8, wherein the second optical sensor is configured to detect a component of a polishing liquid other than water.

10. The assembly of claim 1, comprising a plurality of sensors, the plurality of sensors including a sensor for each supply line of a plurality of pressure supply lines between the carrier head and the pressure control unit.

11. The assembly of claim 10, comprising clips to attach the plurality of sensors to exterior surfaces of tubes that provide the plurality of pressure supply lines.

12. The assembly of claim 1, comprising a plurality of pressure supply lines between the carrier head and the pressure control unit, wherein the sensor is configured to monitor, in sequence, the plurality of pressure supply lines.

* * * * *